US005669498A

United States Patent [19]

Fierek et al.

[11] Patent Number: 5,669,498

[45] Date of Patent: Sep. 23, 1997

[54] TRAY ORGANIZER

[75] Inventors: Robert W. Fierek; David P. Fierek, both of Duluth, Minn.

[73] Assignee: Fiskars Inc., Madison, Wis.

[21] Appl. No.: 674,983

[22] Filed: Jul. 3, 1996

Related U.S. Application Data

[63] Continuation of Ser. No. 377,980, Jan. 25, 1995, abandoned, which is a continuation of Ser. No. 27,649, Aug. 26, 1994.

[51] Int. Cl.[6] ..... B65D 21/02; B65D 85/20

[52] U.S. Cl. ..... 206/373; 206/507; 206/509; 220/23.83

[58] Field of Search ..... 206/372, 373, 206/505, 506, 507, 509, 511, 512; 220/23.83, 23.6, 505, 506, 410

[56] References Cited

U.S. PATENT DOCUMENTS

| | | | |
|---|---|---|---|
| D. 211,551 | 6/1968 | Taylor . | |
| D. 238,112 | 12/1975 | Nowak . | |
| D. 325,281 | 4/1992 | Jordan | D3/74 |
| D. 345,237 | 3/1994 | Stein | D32/53 |
| 2,823,829 | 2/1958 | Frater | 206/507 |
| 3,420,402 | 1/1969 | Frater et al. | 206/507 |
| 4,205,749 | 6/1980 | Carroll et al. | 206/507 |
| 4,671,411 | 6/1987 | Rehrig et al. . | |
| 4,911,295 | 3/1990 | Venegoni | 206/372 |
| 4,993,551 | 2/1991 | Lindsay | 206/373 |
| 5,086,917 | 2/1992 | Dziersk et al. | 206/216 |
| 5,117,979 | 6/1992 | Brightbill | 206/373 X |
| 5,154,303 | 10/1992 | Jordan | 220/23.86 |
| 5,174,447 | 12/1992 | Fleming | 206/373 |
| 5,186,329 | 2/1993 | Fogelberg | 206/372 |
| 5,190,377 | 3/1993 | Kelly | 383/29 |
| 5,386,922 | 2/1995 | Jordan | 220/23.83 |

FOREIGN PATENT DOCUMENTS 2263101 7/1993 United Kingdom .

OTHER PUBLICATIONS

Parachute Bag at p. 4 of Portable Products Inc.'s Catalog.

*Primary Examiner*—Jacob K. Ackun
*Attorney, Agent, or Firm*—Foley & Lardner

[57] ABSTRACT

An organizer, the organizer being configured in such a manner as to have improved stacking and nesting capabilities, a projecting handle and other advantages described herein. The organizer may be used in conjunction with a bucket.

22 Claims, 7 Drawing Sheets

FIG. 6
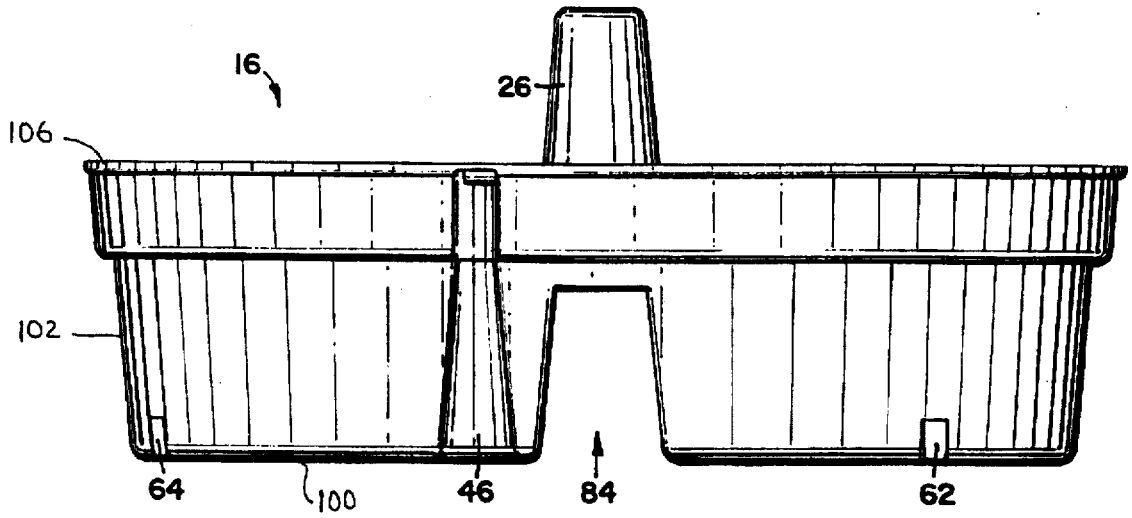
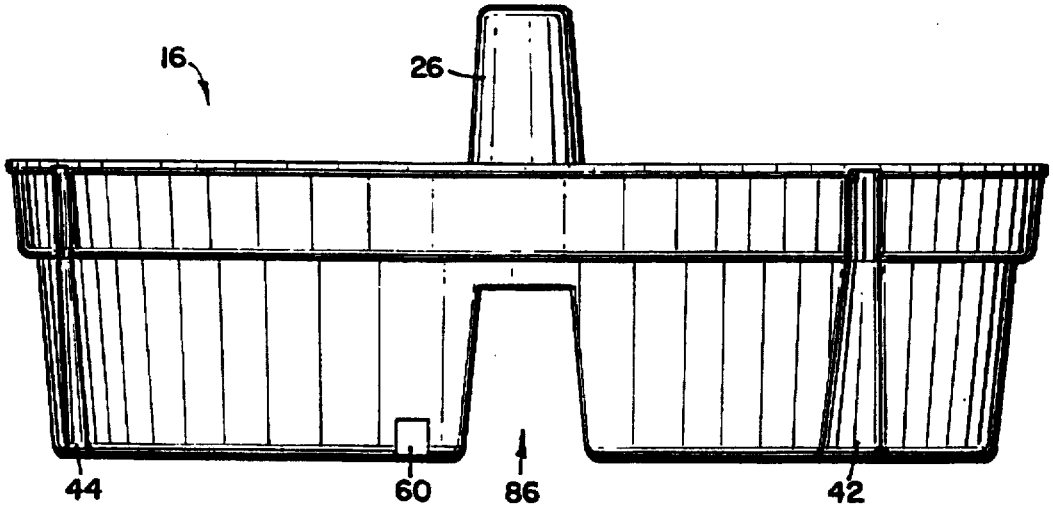
FIG. 7

FIG. 8
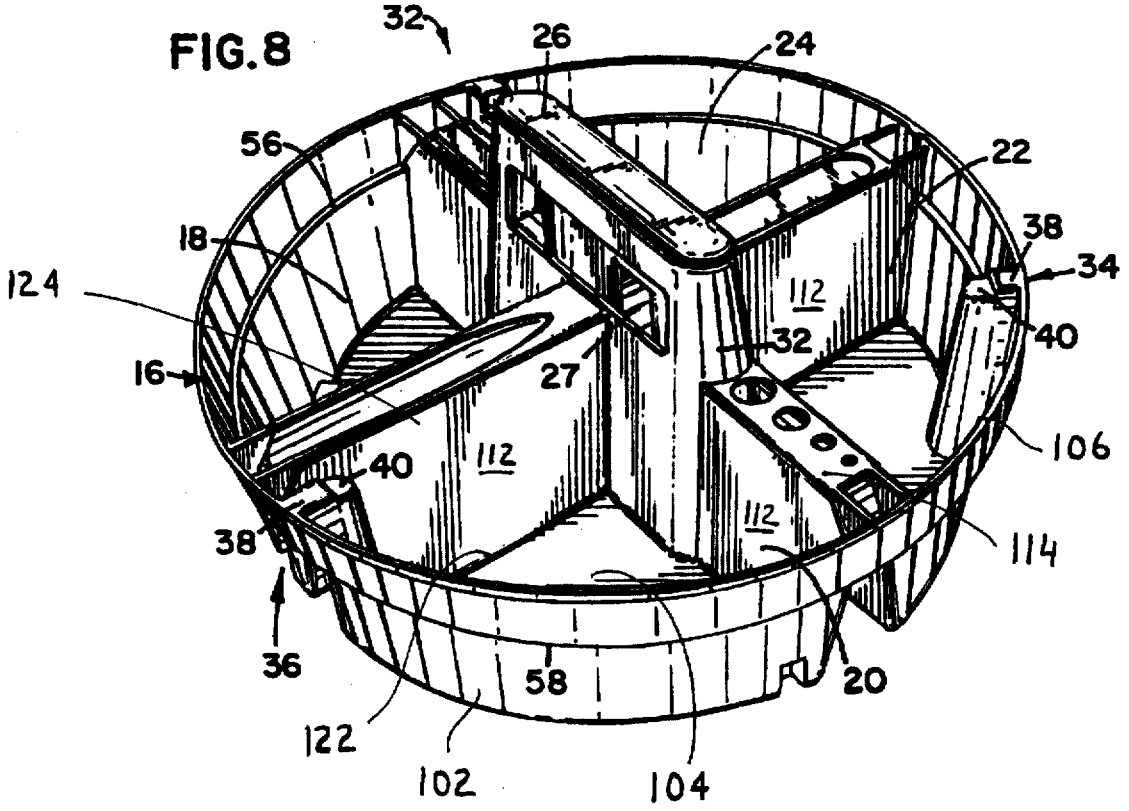
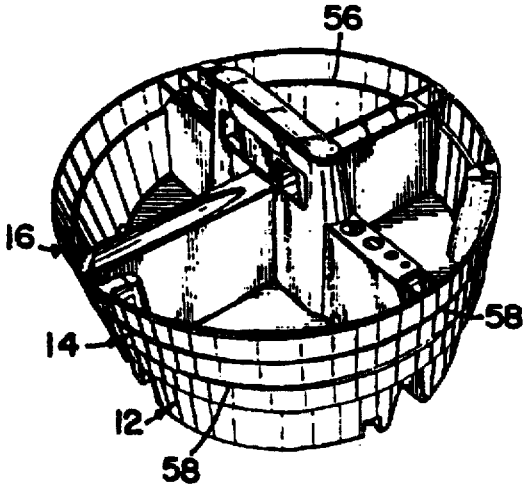
FIG. 9

TRAY ORGANIZER

CROSS-REFERENCE TO RELATED APPLICATIONS

This is a continuation application of U.S. patent application Ser. No. 08/377,980 of Fierek et al. filed Jan. 25, 1995, which is hereby abandoned, and which is a continuation application of co-pending U.S. patent application Ser. No. 29/027,649 filed on Aug. 26, 1994.

FIELD OF THE INVENTION

Bucket mounted tool organizers, comprising fabric like materials, have been adapted to drape over an empty bucket. The use of these tool organizers has become wide spread. The tool organizers generally comprise a plurality of pockets which are useful for the storage and carrying of tools and other small utensils. Items may also be carried inside the bucket such as nails, screws, nuts, bolts, etc. The present invention is directed toward an organizer for the storage of small items inside a bucket. The organizer may also be used not in conjunction with a bucket.

BACKGROUND OF THE INVENTION

It is known to have a generally cylindrical article manufactured from a fabric like material such as canvas or nylon which is draped over an empty pail or bucket (preferably a five gallon bucket, or a "short" five gallon bucket, which has a shorter side wall) thereby converting the bucket to a tool holding device. Such a tool holding device is generally referred to in the industry as a bucket mounted tool carrier. Bucket mounted tool carriers have a plurality of pockets surrounding the outside and inside of the bucket which are useful for tools, or any other utensils which are preferably organized and kept together. An example of a bucket mounted tool carrier is disclosed in U.S. Pat. No. 4,993,551. Typically, these tool carriers have a plurality of pockets located on the outside and often times in the inside of the tool carrier. The inner portion of the tool carrier is open such that larger objects may be placed inside the bucket. Various trays and organizers have been disclosed, which are meant to fit inside the bucket. U.S. Pat. No. 4,154,303 discloses container inserts which are intended to be inserted into the bucket. U.S. Pat. No. 4,911,295 also discloses a bucket organizer insert. U.S. Pat. No. Des. 325,281 discloses a design for a tool organizer. However, a problem which has not been addressed to date, has been that the carrier organizers do not effectively stack, in a user friendly manner. A further problem exists with present organizers is that there is no projecting handle which can be grasped easily. To date, a lip or some cut out in the organizer serves as a handle. This makes it difficult to carry an organizer, especially if it is heavily loaded.

It is an object of this invention to provide a bucket organizer which may nest snugly for shipping purposes, but when in use, is stackable in an easy manner, inside the bucket.

It is also an object of this invention to provide a bucket organizer which can adjust between five gallon buckets and short five gallon buckets.

It is also an object of this invention to provide stacked bucket organizers which do not rotate vis-a-vis one another.

It is also an object of this invention to provide a stackable tool organizer with an easy to use, projecting handle.

SUMMARY OF THE INVENTION

The present invention is an improved organizer to be preferably used in a bucket. The organizers are intended to be stacked, with the stacked organizers to fit within a bucket. A first organizer is to be stacked atop a second organizer, with each of the organizers comprising:

(a) a plurality of compartments defined by partitions, the compartments configured such that upon stacking the organizers in a nesting mode, the first organizer fits within the second organizer;

(b) a handle, the handle projecting upwardly from said organizer, the handle having an interior handle cavity space such that upon stacking a second organizer atop the first organizer, the handle of the first organizer fits within the handle cavity of the second tray organizer; and (c) a means for support, in a functional mode.

The organizer has two modes; a functional mode and a nesting mode. The functional mode has the organizers stacked in a manner such that items may be stored in the compartments. In the preferred embodiment, the functional mode has three positions, which accommodate different bucket heights. The nesting mode has one position, which is used for shipping or storage of the organizers during non-use.

BRIEF DESCRIPTION OF THE DRAWINGS

FIG. 6 is a side view of a tool organizer of the present invention.

FIG. 7 is a side view of a tool organizer of the present invention.

FIG. 8 is a perspective view of a tool organizer of the present invention.

FIG. 9 is a perspective view of three tool organizers of the present invention nested in a shipping mode.

DETAILED DESCRIPTION OF THE INVENTION

The present invention relates to an insert for a bucket which can be used as an organizer for a variety of items. Bucket mounted tool carriers have gained considerable popularity over the years. Bucket mounted tool carriers fit on the outside of a standard five-gallon bucket, as well as other sized buckets, and generally drape both on the outside and the inside of the bucket. The bucket mounted carriers have numerous pockets, which hold tools of all shapes and sizes. The most efficient way to utilize the whole bucket includes storing small tools, or accessory items such as nails, screws, bolts and other accessories on the interior of the bucket. The bucket may be any size, and even any shape, such as a square bucket. The present invention is directed to such a tray organizer.

Figure 1:
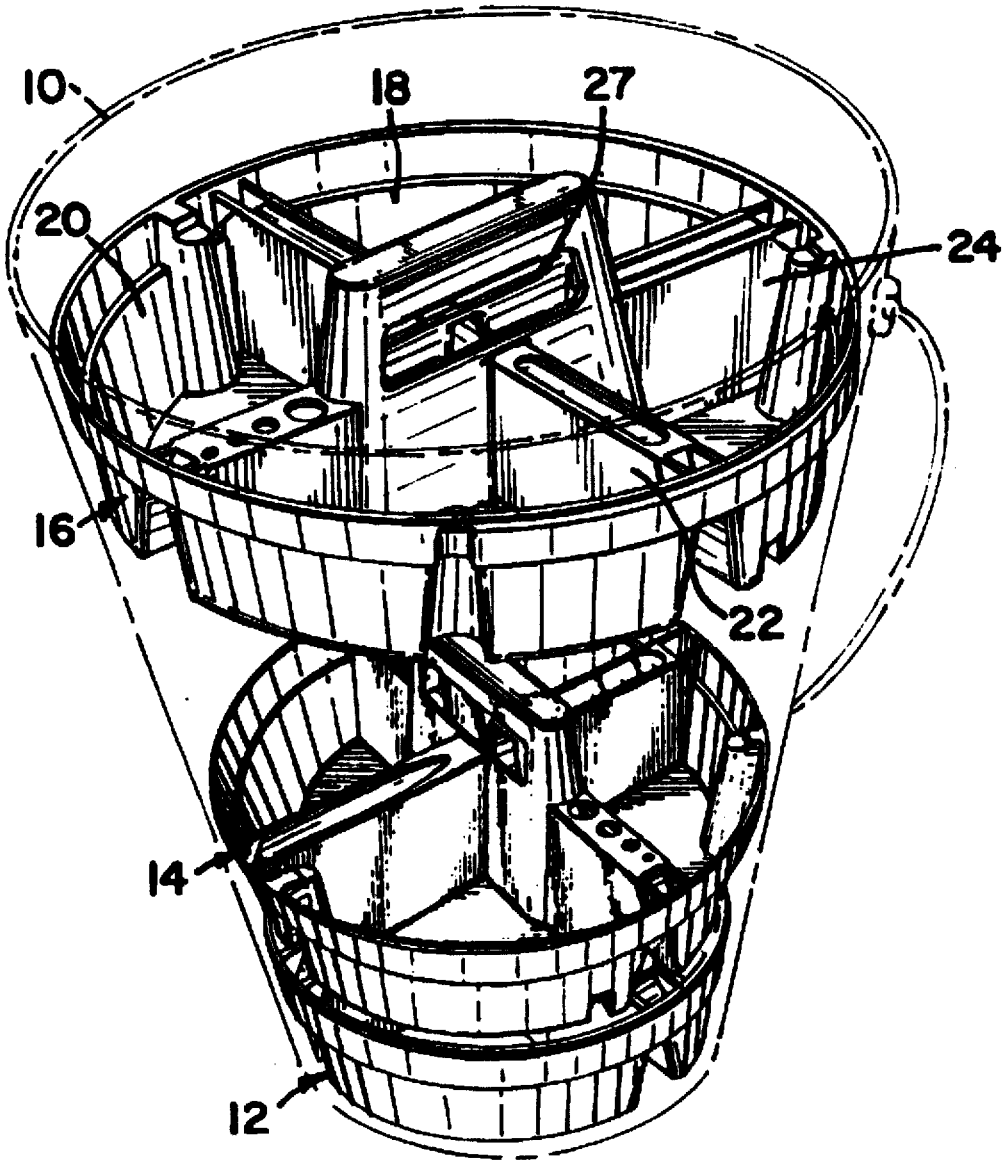
FIG. 1 is perspective view of three of the tool organizers, located in a bucket shown in phantom.

FIG. 1 generally shows a bucket 10 (in phantom) with bucket tray organizers 12, 14 and 16. The bucket organizers 12, 14, and 16 are stacked within the bucket 10, and have compartments shown as 18, 20, 22 and 24 in bucket organizer 16. The compartments 18, 20, 22 and 24 are of sufficient depth to hold any items which might be useful to be carried around in a bucket. It is not necessary that the present invention be used in conjunction with a bucket mounted tool carrier. Indeed, the bucket trays may be sized having two diameters, with one diameter having a circumference such that the bucket organizers fit snugly within the bucket with no bucket mounted tool carrier present, that is it snugly engages the interior wall of the bucket 10. This is shown in FIG. 1. Another sized bucket carrier, not shown, would have a slightly smaller diameter and would accommodate the bucket mounted tool carrier having an interior row of pockets for tools.

There are two stacking modes for the present invention. The stacking modes are a novel and patentable feature of the present invention. One stacking mode shown in FIG. 9 is the stacking mode for storage or shipment of the containers. Typically, these organizers are produced overseas, and thus must nest in a manner which allows them to be shipped overseas, or overland, in an economical manner. The present invention is uniquely configured such that there is one nesting position, but the three remaining positions are in a non-nesting mode. The preferred organizer has four positions. However, more or fewer positions, may be added, through the use of supports, and additional compartments, as described below.

Figure 4:
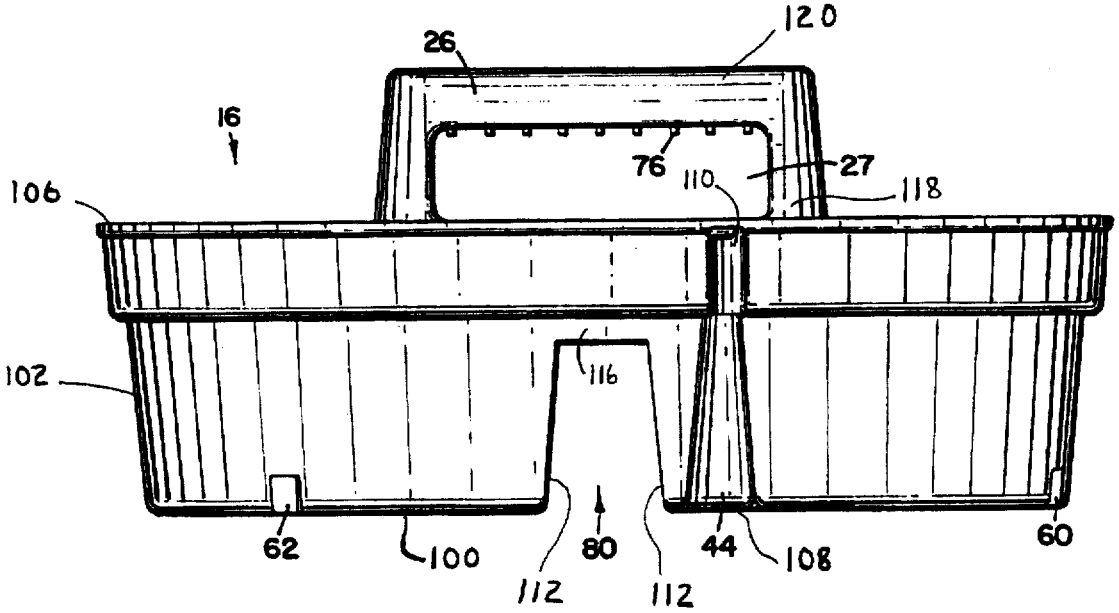
FIG. 4 is a side view of a tool organizer of the present invention.
Figure 5:
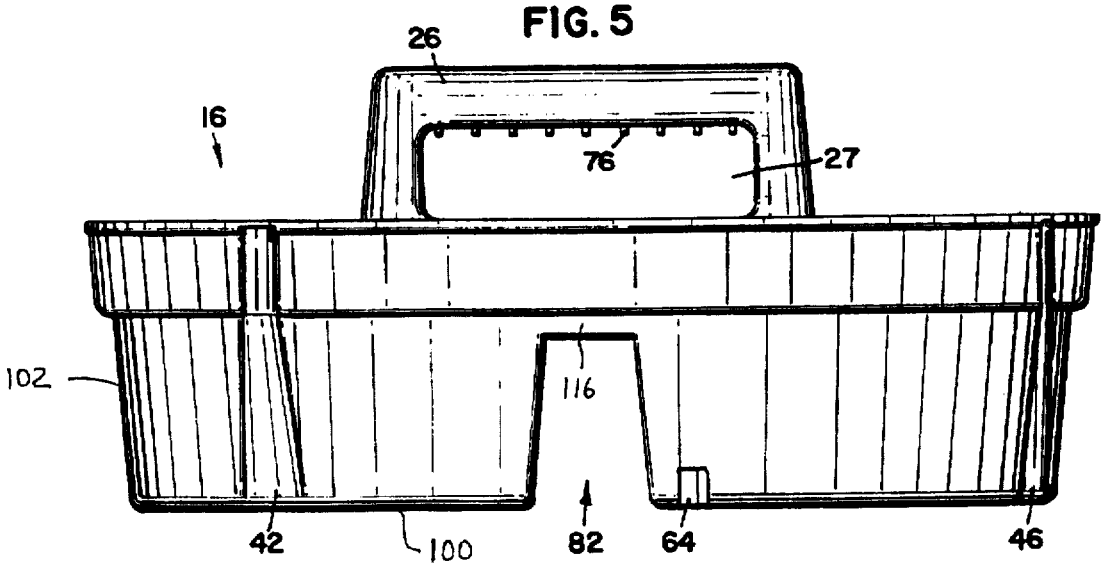
FIG. 5 is a side view of a tool organizer of the present invention.

In reviewing FIG. 8, organizer 16 includes a bottom 100 connected to a surrounding side wall 102. Side wall 102 extends upwardly from bottom 100 thereby forming with bottom 100 a central cavity 104. Side wall 102 has an upper rim 106. Organizer 16 also has supports 32, 34 and 36. The supports have two surfaces 38 and 40, with one surface being a side wall engaging or guiding surface 38 and a lower surface being bottom-engaging surface 40. As is apparent from FIG. 9, when the tray organizers 12, 14, and 16 are nested for shipment or storage, supports 32, 34 and 36 all nest within one another due to the cavity formed in creating the supports 32, 34, and 36. The cavity of the supports is visible in numerous figures, but FIGS. 4 and 5 show cavities 46, 42 and 44 which are created such that supports 32, 34 and 36 fit respectively therein. As more particularly shown in FIG. 4, cavity 44 has an open end 108 proximate bottom 100 and an opposed end 110 bounded by guiding surface 38 which projects inwardly from upper rim 106.

Figure 10:
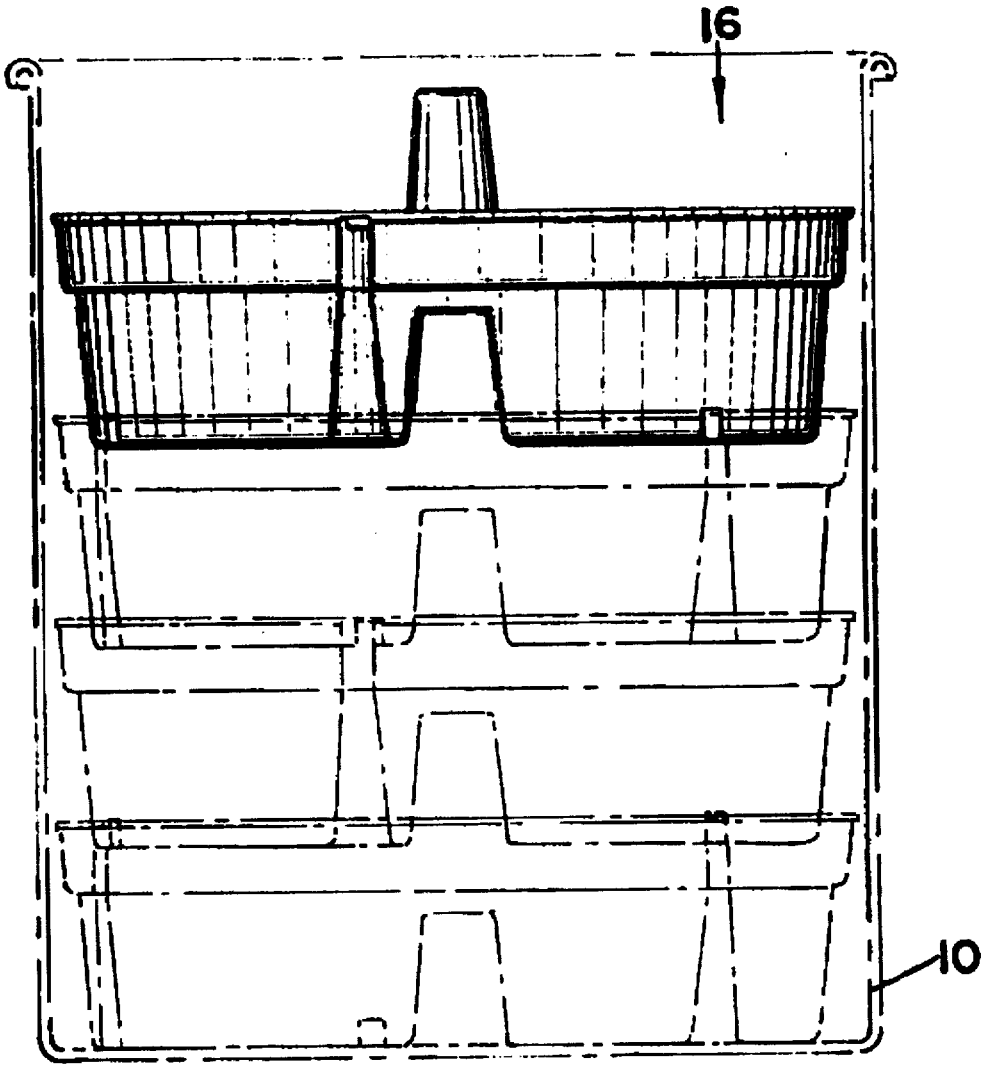
FIG. 10 is a perspective view of four of the tool organizers stacked in their functional mode, with three of the tool organizers in phantom and a bucket shown in phantom.

The nesting position must align supports 32, 34 and 36 respectively. If the supports 32, 34, and 36 are not aligned with cavities 46, 42, and 44, the organizer is not nestable, which is evident from FIGS. 1 and 10. In referring to FIG. 10, if the organizer 48 were rotated 90° in a clockwise manner, the organizer 48 would still stay in a stacked position. If organizer 48 was rotated another 90° clockwise, it would be nested. If organizer 48 were rotated 90° counter clockwise from the position shown in FIG. 10, organizer 48 would still be in a stacked position. From that position, if organizer 48 were rotated another 90° counter clockwise, it would nest, with cavity 50 falling within cavity 52 which is shown in phantom, on the organizer 54 which is situated below the organizer 48. Thus, in the preferred embodiment, the uniquely spaced supports provide three positions whereby the tool tray organizer may be stacked in its functional mode and only one position where it is stacked in a nonfunctional (nestable) mode. Thus, the majority of the stackable positions result in the organizer being useful in a functional mode. More or less supports may be added, with modifications, such that more positions in the functional mode could be achieved. As an example, six supports with six positions or eight supports with eight positions could be used. Each support could also have a different height, thus, for example, six supports could have six different height adjustments.

The supports could be achieved as shown in the figures, or could be separate pieces which snap into a support holding means. The supports also could be part of a living hinge system, which could be assembled downstream from manufacturing.

By "functional" mode it is meant that the tool tray organizer is not nested. This is a "functional" mode because when screws, bolts, wire etc. are stored in the organizer, it is desirable to have the organizer in a stacked mode rather than a nested mode. The nested mode is generally useful during shipping or storage on retailers shelves of the products and thus, it is not used as often. During use, the tool tray organizers are often times pulled out of the bucket, used and thereafter put back in the bucket. Thus, the positioning is constantly being changed during use. It is inconvenient and disconcerting for the user, upon replacing the tool tray organizers, to have the tool tray organizers collapse into a nesting mode. Thus, the present invention, which has a majority of its positions being in a non-nesting mode, makes it easier for the user to stack the tool tray organizers in their functional mode.

Furthermore, in the functional mode, there are two different modes of stacking. The organizers can be stacked to fit within a regular five gallon bucket, or they can be stacked to fit within a short five, without exceeding the height of the rim of the bucket. (Smaller or larger buckets are also envisioned with the size or shape of the bucket being immaterial to the present invention). This is important in that bucket covers or BUCKET SEAT™ covers are sold with the bucket mounted tool organizers, which fit snugly on the rim. If a stack of organizers exceed the top of the rim, the BUCKET SEAT cover cannot be put on the bucket. The preferred present organizers can be stacked four deep, in the functional mode, in either a short five or a regular five gallon bucket.

Figure 3:
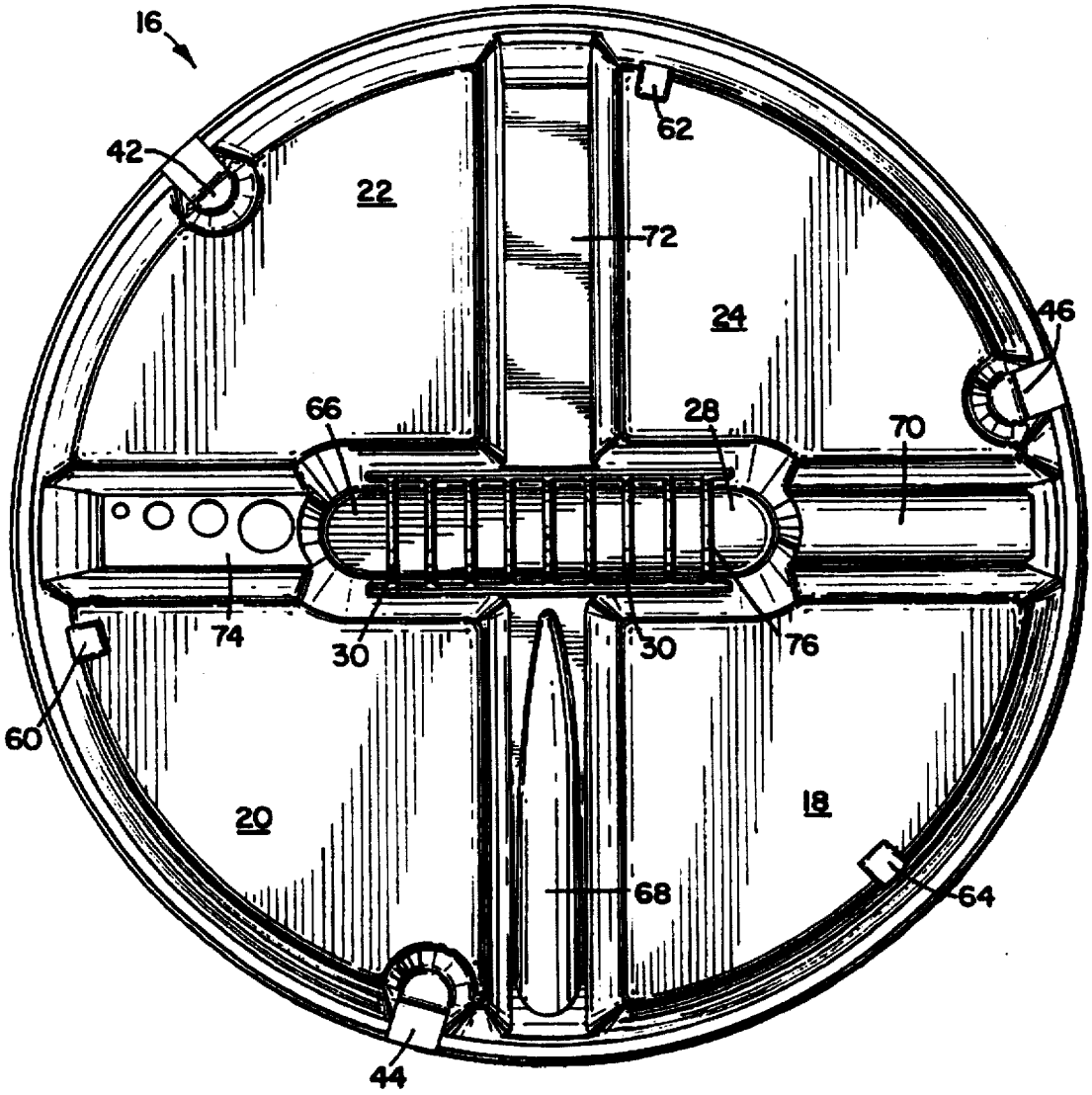
FIG. 3 is a bottom view of a tool organizer of the present invention.

Bottom 100 of the tool tray organizer 16 must be configured such that it may be both nested and put in the functional mode. FIG. 3 is a bottom perspective view of the tool tray organizer 16. Cavities 42, 44 and 46 are visible. Recesses 60, 62 and 64 are also visible in FIG. 3 as well as the other figures. The purpose of these recesses is to engage the supports 32, 34 and 36 during the functional mode. The spacing of supports 32, 34, and 36 is such that in two of the three functional modes, the supports 32, 34, and 36 engage the bottom edge of organizer 16. That is, bottom 100 of organizer 16 is seated on surfaces 40 of 32, 34, and 36. The lower side wall of organizer 16 is pressed flush against the vertical step between surface 40 and supports 32, 34, and 36. These two positions of the functional mode have the organizers situated such that in a preferred embodiment, four organizers will reach the top of a five gallon bucket.

The preferred third position of the functional mode is designed for a short five gallon bucket. This position is accomplished by aligning supports 32, 34, and 36 with recesses 60, 62, and 64. This is the position shown in FIG. 10. This position also provides a "locked" position, as does the other two positions in the functional mode. A locked position is a feature which is desirable such that the organizer is not rotated vis-a-vis the organizer located below it. Unwanted rotation results in movement of the organizer, which is undesirable from a stability standpoint. The locked position means the top organizer cannot be rotated with respect to the organizer located below the top organizer. For example, in FIG. 10, organizer 48 cannot be rotated in a clockwise or counterclockwise fashion, because supports 32, 34, and 36 are located in recesses 60, 62 and 64. This is due to the spacing of the recesses and the supports. The preferred number of supports and recesses is three of each, however more or less than three is possible. There needs to be the same amount of supports as recesses.

FIGS. 6 and 7 are respectively FIGS. 4 and 5 with the tool tray organizer 16 rotated 90° in a counter clockwise fashion. Thus, for FIG. 4, a tool tray organizer is rotated 90° in a counter clockwise fashion thus, cavity 42 is hidden and cavity 46 is brought into view as is shown in FIG. 6 when FIG. 4 is rotated 90°. In the same manner, when FIG. 5 is rotated 90° in a counter clockwise fashion, cavity 42 is brought into view in FIG. 7.

The locked position is also accomplished by the handle 26, extending into channel-shaped cavities 80, 82, 84, and 86, shown in FIGS. 4–7.

Referring more particularly to FIGS. 4 and 8, each channel-shaped cavity 80, 82, 84, and 86 comprises a pair of side panels 112 joined by a central web 114, and is peripherally bounded by a rib 116 which is formed from a portion of side wall 102. When the organizer is in the functional mode, and not in the position where the supports 32, 34, and 36 are within recesses 60, 62, and 64, supports 32, 34, and 36 are engaging the bottom corner edge of the organizer. The organizer is prevented from being rotated in this position by the handle 26, contacting a side panel of channel-shaped cavities 80, 82, 84, or 86. A locked position may also be accomplished by placing a bump/dimple configuration which might have a dimple projecting out of the bottom of the organizer, and a recess on surface 40 .

Referring to FIGS. 8 and 9, bucket tray 16 is shown with handle 26 having a lower portion 118 and a distal upper portion 120. The handle 26 is unique in that other tray organizers have not had a projecting handle. The trays existing to date merely have some lip to grasp, or a small cross bar, but not a projecting handle. Further, the handle 26 has a cavity 27 (shown in FIG. 4) through which a user's fingers can grasp handle 26.

Handle 26 has a hollow interior 28, which is shown in FIG. 3. The hollow interior 28 has ridges 30 at the top of the interior 28 of handle 26. Having a hollow handle 26 allows the exterior of the handle 26, which is shown in FIG. 8 as 32, to be inserted within the hollow portion 28 of a tray organizer when the organizers are in their nesting mode.

FIG. 8, illustrates the tray organizer's interior rim 56. Interior rim is recessed, such that it engages a lower exterior rim 58 of another tool tray organizer. This is evident in FIG. 9, where the FIG. 9, where the trays are nested, with the rims engaging in an abutting relationship.

FIG. 3 illustrates a handle cavity shown as 66, with compartment dividing means shown as 68, 70, 72 and 74 each having a lower margin 122 proximate bottom 100 and a distal upper margin 124. The dividing means can be removable inserts, which are inserted into tracks or clips to hold the dividing means. However, the preferred compartment dividing means are shown. The bottom of compartments 18, 20, 22 and 24 are also shown, but these are not cavities, rather they project out. The ridges, shown in cavity 66, with one ridge identified as 76, are for gripping purposes as well as adding structural support to the handle 26, such that it does not collapse under heavy loads.

Figure 2:
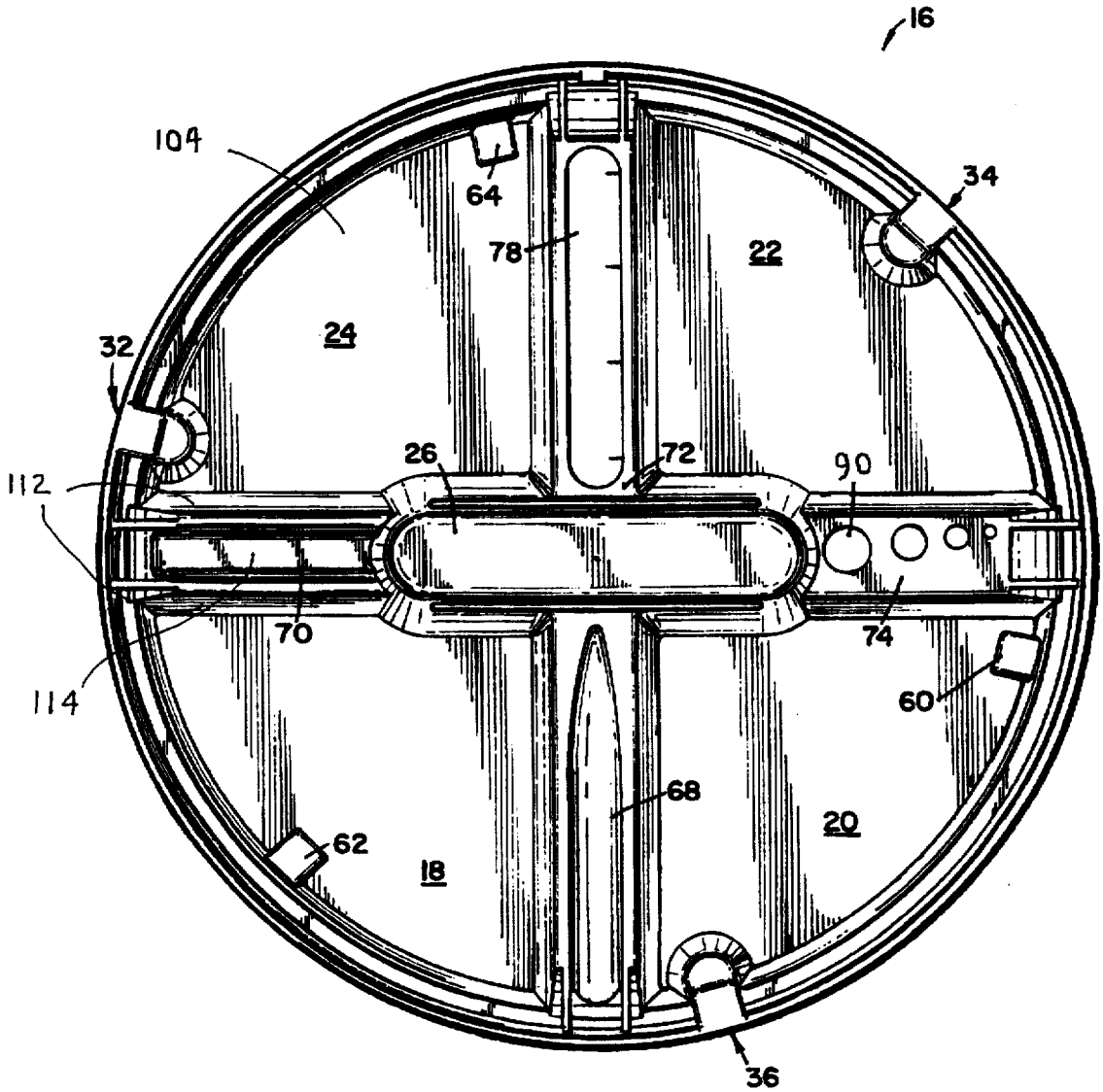
FIG. 2 is a top view of a tool organizer of the present invention.

FIG. 2 is a top view of the tool tray organizer 16 of the present invention. It is useful to incorporate items such as a measuring means shown as 78 on the partition. Often times, small measurements need to be made such as the length of drill bits, screws, nails, etc. It is useful to have a built in measuring means for such situations. Also, the apertures with one shown as 90 may also be built into the partitions or dividing compartments 68, 70, 72 and 74. These holes have different diameters such that the diameters of screws, nails, and drill bits may be measured.

It is to be understood that while the invention has been described above in conjunction with preferred specific embodiments, the description and figures are intended to illustrate and not limit the scope of the invention, which is defined by the scope of the appended claims.

What we claim is:

1. A tray organizer adapted to stack and nest with another tray organizer of identical configuration, the tray organizer comprising:

a bottom connected to a surrounding side wall extending upwardly therefrom and defining a central cavity therewith, the side wall having an upper rim;

a plurality of outwardly facing cavities formed at spaced intervals along the side wall and extending substantially from the bottom to the upper rim, each cavity having an open end proximate the bottom, an opposed end bounded by a guiding surface projecting inwardly from the rim, the guiding surface terminating in a lower surface stepped down therefrom; and a plurality of recesses formed in a region of the side wall proximate the bottom;

the cavities and recesses being arranged and configured so that in a first stacked position the bottom of an upper tray organizer rests on the lower surfaces of a lower tray organizer, and in a second stacked position the recesses of the upper tray organizer removably engage the lower surfaces of the lower tray organizer.

2. The tray organizer of claim 1, wherein the guiding surfaces are substantially parallel to the bottom.

3. The tray organizer of claim 1, wherein the lower surfaces are substantially parallel to the bottom.

4. The tray organizer of claim 1, further comprising a plurality of compartments bounded within the central cavity by dividing means extending thereacross and peripherally bounded by a portion of the surrounding wall intersected by the dividing means, each dividing means having a lower margin proximate the bottom and a distal upper margin.

5. The tray organizer of claim 4, wherein the dividing means are of substantially equal height.

6. The tray organizer of claim 4, wherein the upper margin of at least one of the dividing means lies proximate but below the upper rim.

7. The tray organizer of claim 4, wherein each dividing means comprises a pair of side panels joined by a web to form a generally channel-shaped cavity peripherally bounded by a portion of the side wall thereby defining a rib, and further wherein at least two ribs of an upper tray organizer engage respective upper margins of a lower tray organizer when the upper tray organizer is nested within the lower tray organizer.

8. The tray organizer of claim 7, wherein the webs are narrower than the ribs.

9. The tray organizer of claim 1, further comprising a pair of dividing means extending substantially at right angle across the central cavity.

10. The tray organizer of claim 4, further comprising a handle extending upwardly from the upper margins of two dividing means, the handle having a lower portion and a distal upper portion.

11. The tray organizer of claim 10, wherein each dividing means comprises a pair of side panels joined by a web thereby forming a generally channel-shaped cavity, the handle of a lower tray organizer being substantially received in the channel-shaped cavity of an upper tray organizer when the upper tray organizer is nested within the lower tray organizer.

12. The tray organizer of claim 10, wherein each dividing means comprises a pair of side panels joined by a web thereby forming a generally channel-shaped cavity, the upper portion of the handle of a lower tray organizer being received in the channel-shaped cavity of an upper tray organizer and extending above the upper margins of the upper tray organizer when the upper tray organizer is nested within the lower tray organizer.

13. The tray organizer of claim 4, wherein at least one of the dividing means includes measuring indicia.

14. The tray organizer of claim 4, wherein at least one of the dividing means includes a plurality of sizing apertures.

15. The tray organizer of claim 1, wherein the organizer has a substantially circular configuration.

16. The tray organizer of claim 1, wherein the organizer is made of moldable material.

17. A tray organizer adapted to stack in at least two positions and nest with a tray organizer of similar configuration, the tray organizer comprising:

a receptacle defined by a bottom joined to a surrounding side wall extending upwardly therefrom and having an upper rim;

at least four dividing means disposed across the receptacle, each dividing means having a lower margin and a distal upper margin and comprising a pair of side panels upstanding from the bottom and joined by a web to form a generally channel-shaped cavity, each channel-shaped cavity being peripherally bounded by a rib formed from a portion of the side wall; and a plurality of outwardly facing cavities formed at spaced intervals along the side wall and extending substantially from the bottom to the upper rim, each cavity having an open end proximate the bottom and an opposed end bounded by a guiding surface projecting inwardly from the rim, the guiding surface terminating in a lower surface stepped down therefrom;

whereby in a nested configuration the ribs of an upper tray organizer engage the upper margins of a lower tray organizer.

18. The tray organizer of claim 17, further comprising a handle projecting upwardly from the webs of two substantially aligned dividing means, the handle having a lower portion and a distal upper portion, the upper portion of the handle of the lower tray organizer extending above the upper margins of the upper tray organizer when the upper tray organizer is nested within the lower tray organizer.

19. The tray organizer of claim 17, further wherein the outwardly facing cavities are formed along the side wall such that in a first stacked position the bottom of the upper tray organizer rests on the lower surfaces of the lower tray organizer.

20. The tray organizer of claim 19, further comprising a plurality of recesses formed in a region of the side wall proximate the bottom, the recesses of the upper tray organizer removably engaging the lower surfaces of the lower tray organizer when the upper and lower tray organizers are in a second stacked position.

21. An upper tray organizer adapted to nest or stack with a lower tray organizer, the upper and lower tray organizers being substantially identical, each tray organizer comprising:

a bottom connected to a surrounding side wall extending upwardly therefrom and defining a central cavity therewith, the side wall having an upper rim;

a plurality of outwardly facing cavities formed at spaced intervals along the side wall and extending substantially from the bottom to the upper rim, each cavity having an open end proximate the bottom, an opposed end bounded by a guiding surface projecting inwardly from the rim, the guiding surface terminating in a lower surface stepped down therefrom; and a plurality of recesses formed in a region of the side wall proximate the bottom;

the cavities and recesses being arranged and configured so that in a first stacked position the bottom of the upper tray organizer rests on the lower surfaces of the lower tray organizer, and in a second stacked position the recesses of the upper tray organizer removably engage the lower surfaces of the lower tray organizer.

22. The tray organizer of claim 21, further comprising a plurality of compartments bounded within the central cavity by dividing means extending thereacross and peripherally bounded by a portion of the surrounding wall intersected by the dividing means, each dividing means having a lower margin proximate the bottom and a distal upper margin, each dividing means comprising a pair of side panels joined by a web to form a generally channel-shaped cavity peripherally bounded by a rib, the ribs of the upper tray organizer engaging the upper margins of the lower tray organizer when the upper tray organizer is nested within the lower tray organizer.

* * * * *

UNITED STATES PATENT AND TRADEMARK OFFICE

CERTIFICATE OF CORRECTION

PATENT NO. : 5,669,498

DATED : September 23, 1997

INVENTOR(S) : Fierek et al.

It is certified that error appears in the above-identified patent and that said Letters Patent is hereby corrected as shown below:

Column 1, line 48, delete "is that" and insert --in that--.
Column 1, line 50, delete "cut out" and insert --cut-out--.
Column 2, line 26, insert --a-- after "is".
Column 3, line 10, insert a comma --,-- after "that is".
Column 3, line 54, insert a hyphen -- - -- after "counter".
Column 3, line 57, delete "counter clockwise" and insert --counterclockwise--.
Column 4, line 17, delete "retailers" and insert --retailers'--.
Column 4, line 38, insert "™" after "SEAT".
Column 4, line 42, delete "the" after "of".
Column 5, line 11, delete "counter clockwise" and insert --counterclockwise--.
Column 5, line 13, delete "counter clockwise" and insert --counterclockwise--.
Column 5, line 16, delete "counter clockwise" and insert --counterclockwise--.
Column 6, line 3, delete "built in" and insert --built-in--.
Column 6, line 27, delete "and".
Column 6, line 29, insert --and-- after "bottom;".

UNITED STATES PATENT AND TRADEMARK OFFICE

CERTIFICATE OF CORRECTION

PATENT NO. : 5,669,498

DATED : September 23, 1997

INVENTOR(S) : Fierek et al.

It is certified that error appears in the above-identified patent and that said Letters Patent is hereby corrected as shown below:

Column 7, line 36, delete "and".
Column 7, line 44, insert --and-- after "therefrom;".
Column 8, line 4, delete "further".
Column 8, line 28, delete "and".
Column 8, line 30, insert --and-- after "bottom;".

Signed and Sealed this

Twenty-second Day of December, 1998

Bruce Lehman

*Attest:*

BRUCE LEHMAN

*Attesting Officer*

*Commissioner of Patents and Trademarks*